United States Patent [19]

Toy

[11] Patent Number: 4,545,514

[45] Date of Patent: Oct. 8, 1985

[54] METHOD AND APPARATUS FOR DISPLAYING GARMENTS

[76] Inventor: Malcolm D. Toy, 425 Willow Pl., Pittsburgh, Pa. 15218

[21] Appl. No.: 473,368

[22] Filed: Mar. 8, 1983

[51] Int. Cl.[4] ..... A41H 5/00

[52] U.S. Cl. ..... 223/66; 223/88; 223/93; 223/68

[58] Field of Search ..... 223/61, 66, 68, 69, 223/71, 90, 93, 85, 91, 88, 92, 120, DIG. 2

[56] References Cited

U.S. PATENT DOCUMENTS

| | | | |
|---|---|---|---|
| 2,279,517 | 4/1942 | Oestricher . | |
| 2,428,820 | 10/1947 | Therrien | 223/88 |
| 2,796,206 | 8/1957 | Schwartz . | |
| 2,919,501 | 1/1960 | Settler | 223/61 |
| 3,120,331 | 2/1964 | Brooke | 223/91 |
| 3,330,452 | 7/1967 | Henderson | 223/68 |
| 3,552,609 | 1/1971 | Alpert | 223/93 |
| 4,311,260 | 1/1982 | Toy . | |

FOREIGN PATENT DOCUMENTS

| | | | |
|---|---|---|---|
| 548278 | 8/1929 | Fed. Rep. of Germany | 223/68 |
| 1123504 | 9/1956 | France . | |

*Primary Examiner*—Werner H. Schroeder
*Assistant Examiner*—A. Falik
*Attorney, Agent, or Firm*—Stanley J. Price, Jr

[57] ABSTRACT

An upper torso frame includes a pair of vertical members with a waist well extending between and connected to the lower end portions of the vertical members. A shoulder member is positioned on the vertical members upper end portions. The shoulder member is connected to the upper ends of the vertical members for forward and backward pivotal movement. A pivot carrying link is connected by friction hinges at one end to each vertical member upper end portion and at the opposite end to the upper portion of an arm member so as to pivotally connect a pair of arm members to the upper torso frame. The pivot carrying link is pivotal on the torso frame and each arm member is pivotal on the pivot carrying link to thereby provide multiple degrees of pivotal movement of the arm members relative to the upper torso frame. Each arm member includes an upper portion and a lower portion where the adjacent ends of the upper and lower portions are connected by pivot carrying links which permit the arm member portions to move relative to each other, as well as to the torso frame. The torso frame is self supporting or can be connected to a base or to a lower torso frame to provide a full figure garment display rack. The upper torso frame also includes a plurality of clips connected by elastic strap-like members to the upper torso frame for drawing the garment tightly over the upper torso frame.

20 Claims, 13 Drawing Figures

METHOD AND APPARATUS FOR DISPLAYING GARMENTS

BACKGROUND OF THE INVENTION

1. Field of the Invention

This invention relates to method and apparatus for displaying garments and more particularly to pivotal neck and arm members connected by a plurality of friction hinges to a torso frame so as to facilitate the support and imaginative display of an upper garment which is secured tightly around the torso frame by clips connected to elastic straps extending from the torso frame.

2. Description of the Prior Art

It is well known in the retail clothing business to display garments in show windows and stores in a manner that promotes sales of the garment. It has been the conventional practice for many years to display garments on mannequins made of papier-mache' which provide a full round configuration that simulates the human form for both the upper torso and the lower torso. Mannequins, however, due to their rigid construction, are limited in their ability to imaginatively display an item of wearing apparel. The principal objection to mannequins is that they are stiff figured and do not impart an action-like pose for display of a garment. U.S. Pat. No. 4,311,260 discloses a garment display rack for supporting garments on a lower torso frame that is formed by a plurality of pivotally connected members which are adapted for independent pivotal movement to preselected angular positions along the length of the display rack to generate an imaginative pose for displaying the garment.

U.S. Pat. No. 3,294,295 discloses a garment display mannequin for displaying shirts, sweaters, jackets and other similar garments in which "full round" upper and lower hollow shell forms are mounted on a tube which is telescopically arranged between the upper and lower forms to permit adjusting the height of the mannequin for showing an upper garment of any length on the mannequin. Detachable rod-like arms are connected to the shoulders of the upper frame. The arms include upper and lower portions which are angularly adjustable relative to one another.

U.S. Pat. No. 2,707,070 discloses an upper torso display form that includes a vertical rod telescopically supported on a base. At the upper end of the rod is connected a shoulder rod which is connected at its end portions to a wire centrally bent to complete a loop with the upper shoulder and form an upper torso. Extending from the shoulders are arm members that include a plurality of tubular sections and spherical sections strung on a wire form extending through the tubular sections. The tubular and spherical sections are held in frictional engagement with each other thereby permitting arm sections to be swung up or down or toward the front or toward the rear of the torso frame. This structure is intended to present a realistic appearance to a garment, such as a blouse, displayed on the form.

British Pat. No. 635,459 is an example of a device for displaying an upper garment that includes a wire-like frame mounted on a base and including vertically and laterally adjustable frame members which permit adjustment of the bust measurement so that a garment, such as a blouse, can be tightly drawn over the frame. British Pat. No. 678,463 is an example of a bust form that is provided with a pair of shoulder portions which are hinged to a main torso frame. Spring means are provided to normally press the shoulders outwardly and thereby facilitate selective positioning of the shoulders on the main torso frame. Further, British Pat. No. 826,764 and French Pat. No. 1,123,504 are examples of full figure dress forms that utilize wire or tubular members that form connected upper and lower torsos. The arm and leg members are pivotally connected to the main supporting frame to permit adjustments in the manner in which upper and lower garments are displayed.

U.S. Pat. Nos. 2,279,517; 2,620,099; 2,796,206; 2,814,424; 3,033,429 and 3,084,837 are further examples of known devices that incorporate the concept of a traditional mannequin-like form with means for adjusting the shoulder width and the length of a torso so that the display form can be utilized for more than one type of garment. While it has been suggested by the prior art devices to modify the well known papier-mache' mannequin to include shoulder and arm members that impart more action oriented poses to the display form and to depart from the full-round configuration of a mannequin, the known garment display forms do not provide structure which satisfactorily displays and supports an upper garment.

The dress forms of the tubular construction do not provide shoulder and arm members have sufficient surface area for supporting the garment in a life-like pose. Upper garments displayed on a tubular or wire constructed torso form are loosely displayed so as to hang or drape in an unattractive manner in comparison with the display of the garment accomplished with the full-round configuration of a papier-mache' mannequin. The principal advantages achieved with the tubular or wire-like forms is the adjustability which is available in positioning the arm and neck portions relative to the bust. This, however, is not available with the traditional mannequin form. Therefore there is need for an upper garment display rack that is operable to attractively display a garment as it would be naturally worn and permit the garment to be displayed in a variety of imaginative poses.

With the traditional papier-mache' mannequin, as well as the tubular display forms above discussed, it is the practice to secure an upper garment such as a shirt or a blouse, to the display form by the use of a plurality of straight pins. This operation is time consuming and requires skilled labor. It is well known in order to display a blouse or shirt in a tucked and pleated manner on a form, that at least two dozen straight pins are required. The use of straight pins to secure a garment to an upper torso display form is therefore a high labor, intensive operation.

Therefore there is further need for an upper torso display form that permits securing a garment in an attractive fashion to the form without the need for straight pins and can be carried out efficiently without the need for highly skilled labor.

SUMMARY OF THE INVENTION

In accordance with the present invention, there is provided an upper garment display rack that includes an upper torso frame including a pair of upwardly extending torso members positioned in spaced relation. Each of the torso members has an upper end portion and a lower end portion. An open waist well extends transversely between the torso members and is connected to the torso members lower end portions to maintain the torso members a preselected distance apart. A shoulder member extends transversely above the torso members upper end portions. Shoulder pivot means pivotally connects the shoulder member to the torso members upper end portions for forward and backward movement of the shoulder member relative to the upper torso frame. A pair of arm members is positioned adjacent to the pair of torso members respectively. Each of the arm members has an upper portion and a lower portion. The upper and lower portions have adjacently positioned ends. The upper and lower portions have supporting surfaces for receiving a garment to support the garment for display in a plurality of positions. Upper pivot carrying link means connects the arm members upper portions to the torso members upper end portions for pivotal movement of the arm member upper portions in more than one direction relative to the torso members. Lower pivot carrying link means connects adjacent ends of the arm members upper and lower portions for pivotal movement of the arm member lower portion in more than one direction relative to the arm member upper portion. The upper and lower pivot carrying link means are independently operable together with the shoulder pivot means to permit selective angular positioning of the shoulder member and the arm members relative to the upper torso frame.

The upper pivot carrying link means includes an angle brace that is pivotally connected at one end to the respective arm member upper portion and at another end to the respective upper end portion of the vertical torso member. The pivot connection of the brace to the respective members is a friction-type hinge that is preset at a preselected torque to permit pivotal movement of the brace and therefore the entire arm to a preselected position where the brace remains in the preselected position without requiring engagement or disengagement of fastening members to move the brace from one position to another or to maintain the brace in the preset angular position.

Similarly, the pivotal connection of the arm member at its upper end to the brace is also accomplished by a friction hinge, thus allowing the arm to be pivoted relative to the brace which, in turn, has been pivoted to a preset position relative to the upper torso frame. With this arrangement the brace is rotational about a first axis extending outwardly from the upper end portion of the respective torso member constituting the shoulder joint of the torso frame. The arm member is then pivotal on the brace about an axis which is angularly disposed relative to the pivotal angle of the brace. The arm member is thus pivotal to a plurality of angular positions to facilitate a creative display of the sleeve of a garment draped on the upper torso frame.

The lower pivot carrying link means for connecting adjacent ends of the arm members upper and lower portions also includes a brace pivotally connected by a friction hinge to the arm member upper portion and at the opposite end by a friction hinge to the arm member lower portion. This arrangement facilitates movement of the lower portion to a preselected position relative to the upper portion and further pivotal movement of the lower portion relative to the brace. Thus, each arm member, including the upper and lower portions, is pivotal to substantially unlimited angular positions by the provision of the shoulder pivot means and the upper and lower pivot carrying link means.

The torso frame is self-supporting on the waist well which includes a pair of spaced apart transversely extending members connected to the lower end portions of the upwardly extending torso members. The waist well members are maintained in spaced relation and provide a support for the upper torso frame. Provision is also made for support of the display rack on a rod and base where a rod extending from a base passes through the members of the waist well into a socket of a bracket positioned on brace members extending between the vertical torso members.

Means is also provided for engaging a garment tightly over the frame so that the garment may be neatly displayed eliminating loosely hanging material and therefore the need to secure the garment to the frame by conventional means using straight pins. The means for attaching the garment to the form includes a plurality of elastic straps suspended from the upper torso frame. Each of the elastic straps is provided with a clip which is engageable with the various portions of the garment. The clips are selectively connected to the side seams and lower end portions of the garment which are drawn upwardly through the open waist well so as to exert tension on the garment to form and hold pleats and folds as desired.

The upper garment display rack of the present invention is also operable for connection to a lower garment display rack including a pair of laterally and pivotally adjustable leg frame members for receiving a pair of trousers. In this manner, an integrated display of upper and lower garments is provided in which the display form includes shoulder, arm and leg members which are independently movable to a plurality of positions for attractively displaying the garments as well as neatly supporting the garments tightly on the form. The integrated display rack can be supported by a base, and a plurality of integrated display racks can be supported on a single base in an elaborate and action-oriented display of garments.

Further in accordance with the present invention there is provided a method for displaying an upper garment on a display form comprising the steps of draping the body of a garment on an upper torso frame. Sleeves of the garment are supported in preselected angular positions relative to the upper torso frame. The opposite side seams of the garment adjacent the sleeves are engaged by tensioned clip means to draw the side seams tightly against the upper torso frame. Front and back portions of the garment are folded upwardly toward the upper torso frame. The rear portion of the garment is engaged by tensioned clip means to draw the rear portion tightly over the upper torso frame. The front portion of the garment is engaged by tensioned clip means to draw the front portion tightly over the upper torso frame.

Accordingly, the principal object of the present invention is to provide a method and apparatus for displaying garments that includes an upper garment display rack having a plurality of articulated arm members connected to a torso frame where the arm members are movable to a plurality of pivoted positions relative to the frame and include upper and lower arm portions pivotally movable relative to each other to provide infinitely variable positioning of the arm members for imaginatively displaying an upper garment.

Another object of the present invention is to provide an upper garment display rack including a central torso frame that is pivotally connected to a shoulder member and a pair of arm members by a plurality of friction joints which are operable to permit unlimited pivotal movement of the members to selected angular positions which are retained without requiring engagement and disengagement of fastening elements.

A further object of the present invention is to provide a method of displaying an upper garment on a form that includes a plurality of articulated members forming the shoulder and arms of the form and utilizing tensioning means for tightly engaging the garment to the form.

An additional object of the present invention is to provide a garment display rack that includes an articulated upper torso frame detachably connected to a lower torso frame permitting both upper and lower garments to be displayed on a single form in a plurality of imaginative and action-oriented positions.

These and other objects of the present invention will be more completely disclosed and described in the following specification, the accompanying drawings, and the appended claims.

DESCRIPTION OF THE PREFERRED EMBODIMENTS

Figure 1:
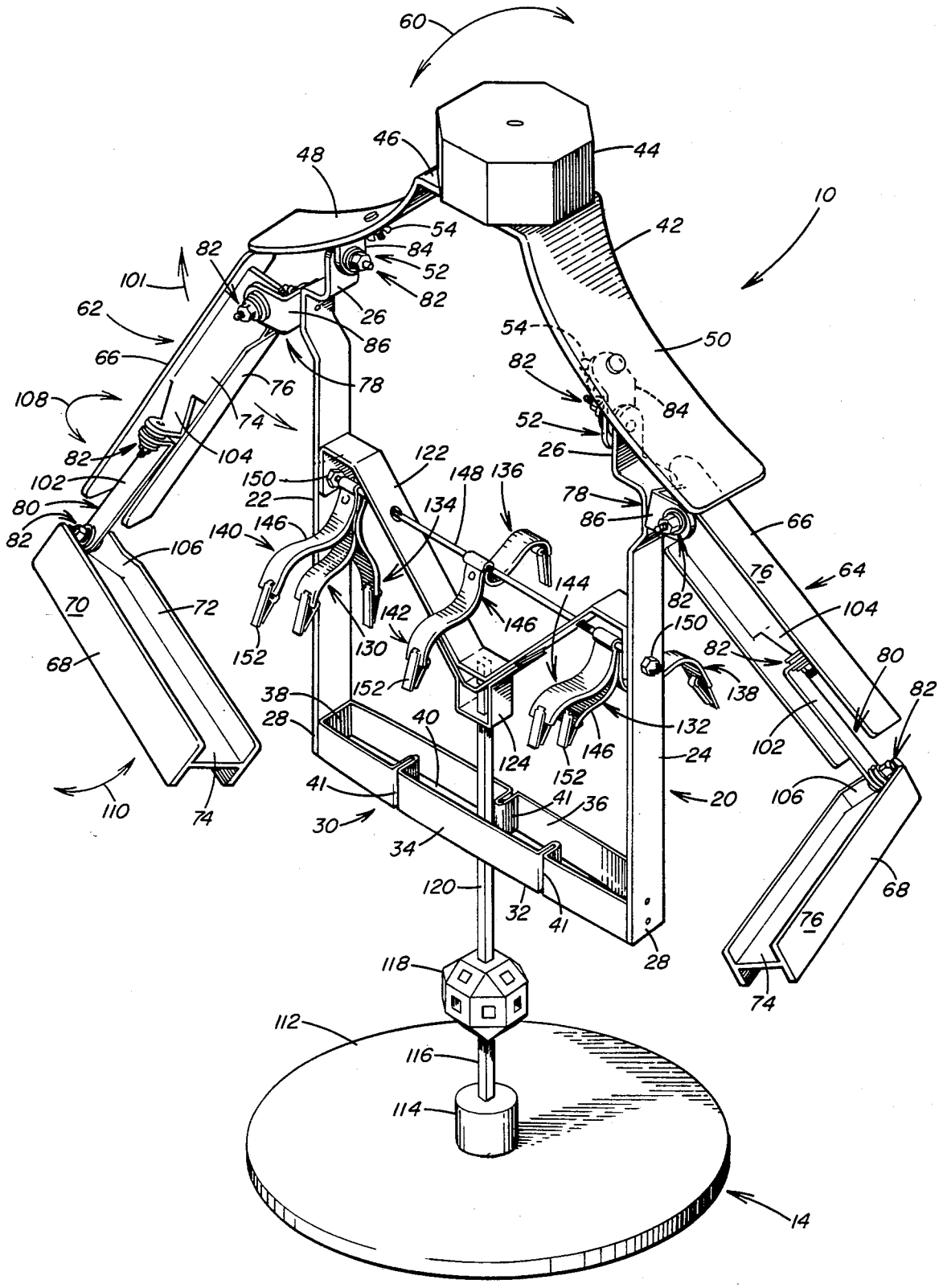
FIG. 1 is a perspective view of an upper garment display rack in accordance with the present invention.
Figure 3:
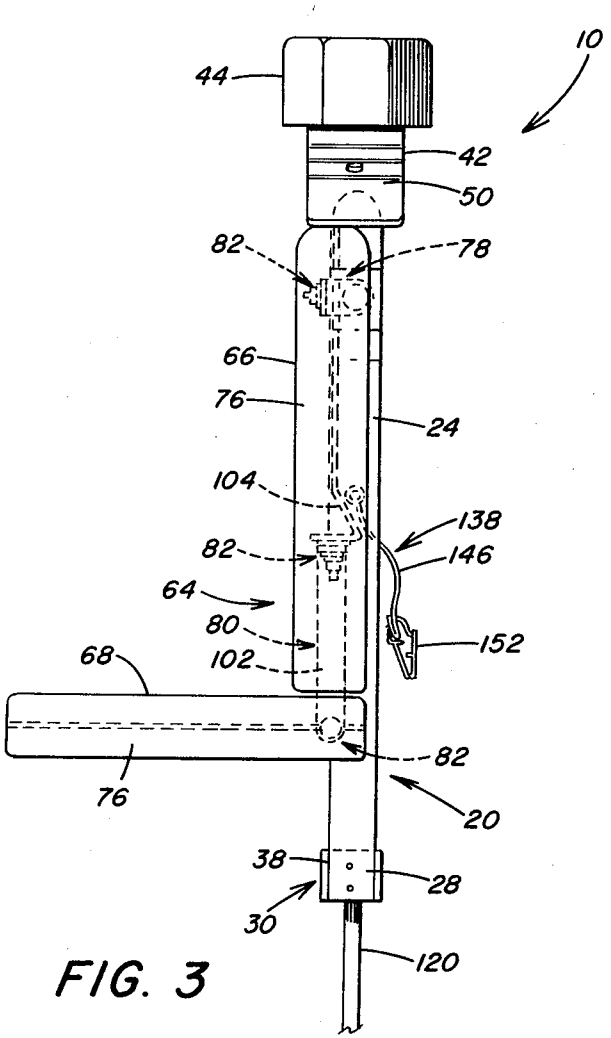
FIG. 3 is a side view, in elevation, of the upper garment display rack shown in FIG. 2, illustrating tensioned clip devices for engaging the garment tightly on the display rack.
Figure 2:
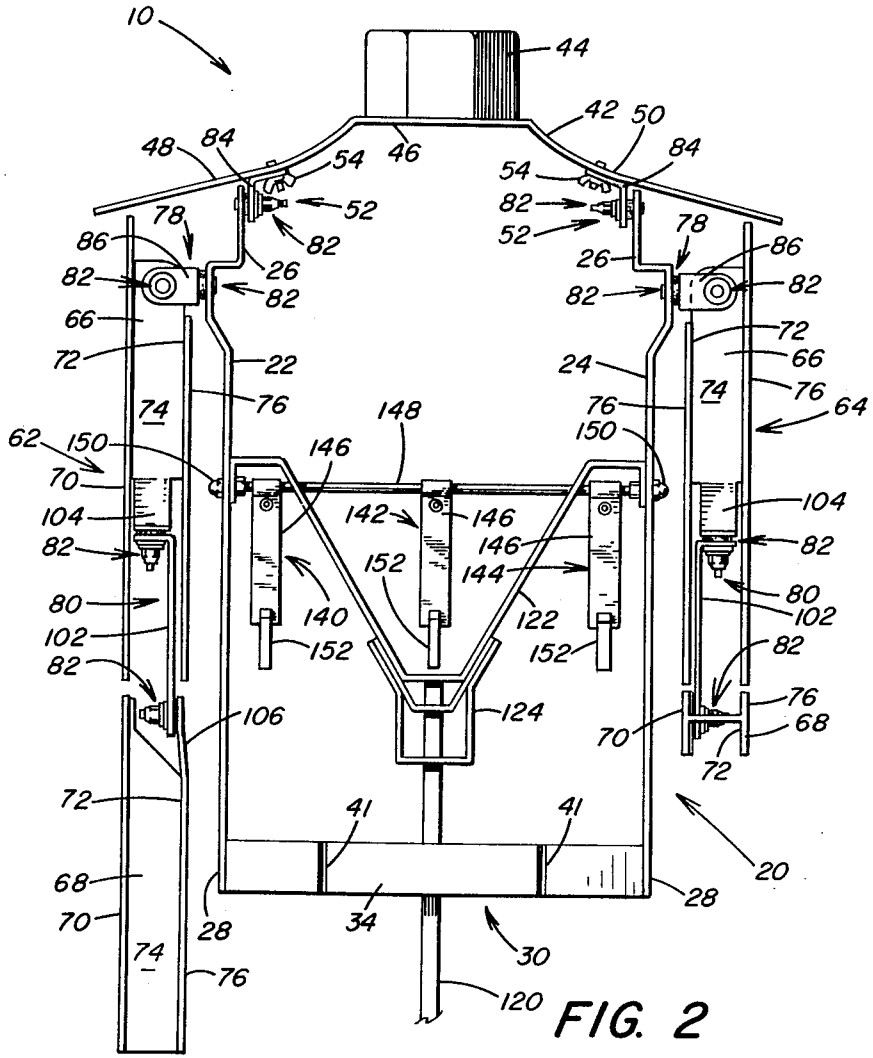
FIG. 2 is a front view in elevation of the upper garment display rack, illustrating a torso frame pivotally connected to a shoulder member and a pair of articulated arm members in accordance with the present invention.
Figure 10:
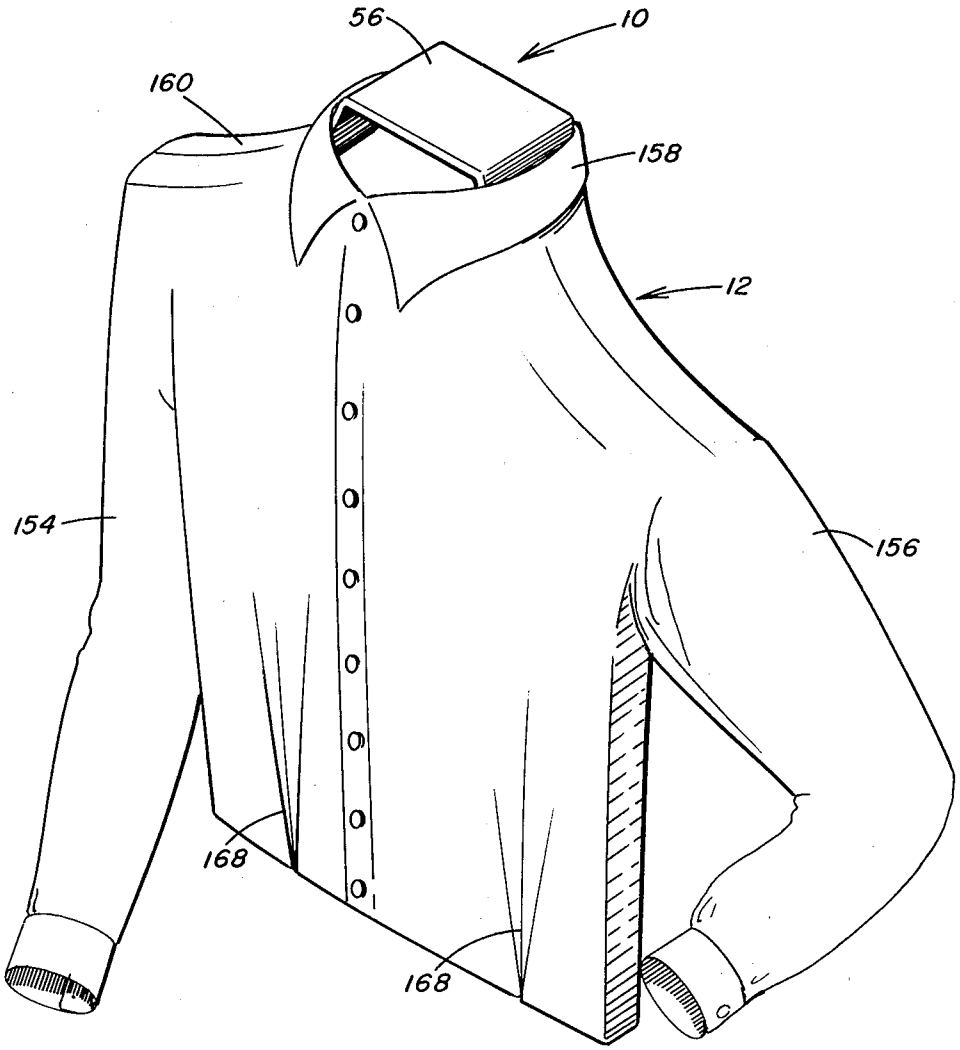
FIG. 10 is a schematic illustration of a shirt completely dressed on the upper garment display rack.

Referring to the drawings, and more particularly, to FIGS. 1, 2, and 3, there is illustrated an upper garment display rack generally designated by the numeral 10 for displaying garments such as a shirt or blouse 12 as illustrated in FIG. 10, as well as coats, jackets, ties and the like in an imaginative manner to promote merchandising of the upper garment in a display window or a store. The display rack 10 is capable of being supported by a base generally designated by the numeral 14 in FIG. 1 or on a lower garment display rack generally designated by the numeral 16 in FIG. 11, which, in turn, is mounted on a base 18 similar to the base 14 shown in FIG. 1.

Figure 13:
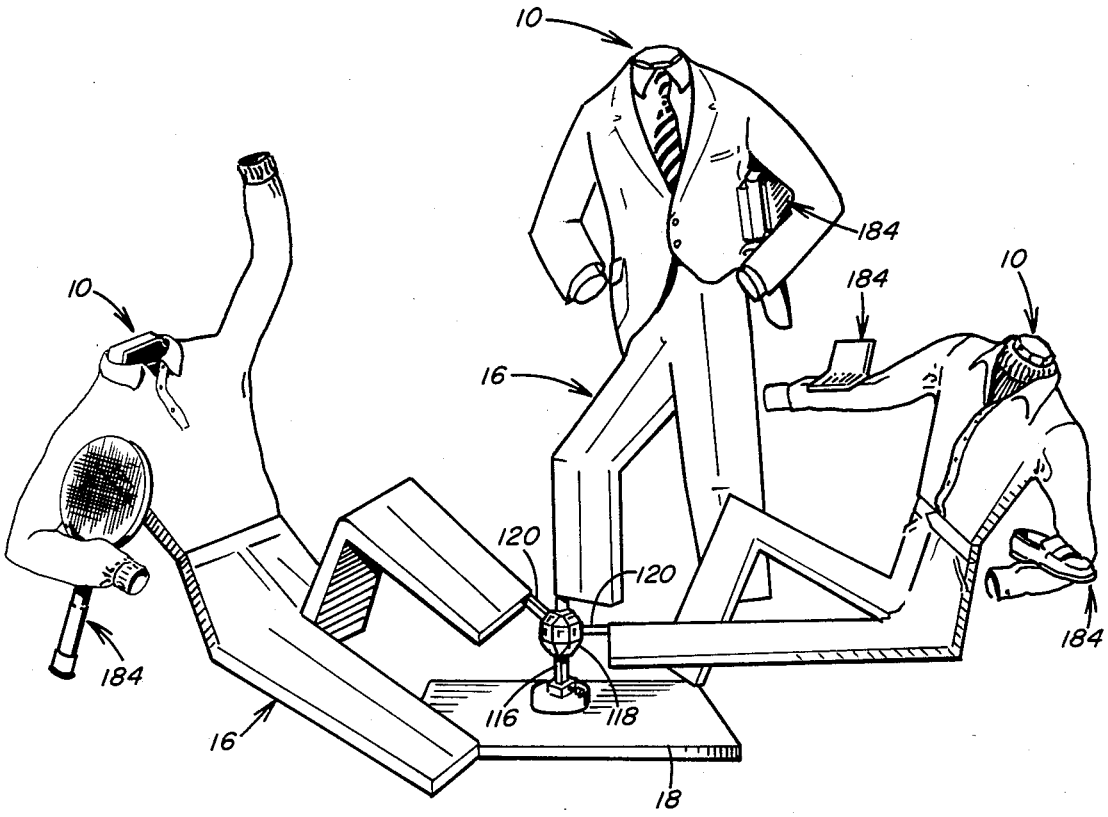
FIG. 13 is a schematic view of upper and lower garments supported by a plurality of garment display forms shown in FIG. 11, illustrating each of the forms supported in an action-oriented pose from a common base.

As will be explained later in greater detail, the upper garment display rack 10 is releasably connectable to the lower garment display rack 16, which is described in greater detail in U.S. Pat. No. 4,311,260. With these two arrangements, the display rack 10 can be utilized individually or in combination with the display rack 16. A plurality of garment display forms is provided in accordance with the present invention for displaying in an imaginative and life-like fashion, as illustrated in FIG. 13, wearing apparel of various styles.

As illustrated in FIGS. 1–3, the upper garment display rack 10 includes an upper torso frame 20 having a U-shaped configuration formed by a pair of vertical members 22 and 24 positioned in spaced parallel relation. Each of the vertical members 22 and 24 has an upper end portion 26 and a lower end portion 28. A waist well generally designated by the numeral 30 extends transversely between the vertical torso members 22 and 24. The waist well 30 is formed by a band-like member 32 that is suitably connected as by rivets or welding to the lower end portions 28 of the vertical members 22 and 24. The waist well 30 serves to maintain the members 22 and 24 a preselected distance apart.

The band-like member 32 includes a front bar 34 connected to a rear bar 36 by side bars 38 in an arrangement where the bars 34, 36, and 38 are integrally connected and bent to the desired configuration to maintain the front and rear bars 34 and 36 in spaced relation so as to provide a well or opening 40 between the bars 34 and 36 to accommodate the securement of an upper garment to the rack 10 in accordance with the method of the present invention. The bars 34 and 36 are provided with notches or recesses 41 for receiving the garment at the waist well 30 at selected locations for the formation of pleats or tucks in the garment when displayed on the rack 10.

Figure 5:
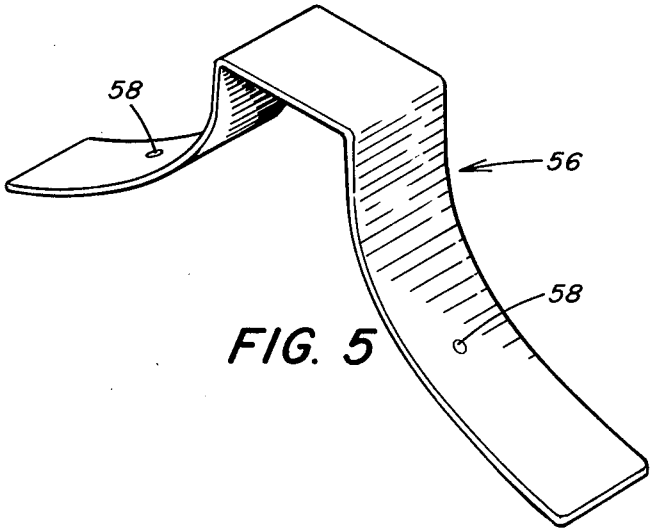
FIG. 5 is a perspective view of an alternate embodiment of the shoulder member for the display rack.

A shoulder member 42 extends transversely above the vertical member upper end portions 26. The shoulder member includes a neck block 44 secured to a horizontal member 46 which, in turn, is integrally connected to a pair of arcuately shaped downwardly curved members 48 and 50. The curved members 48 and 50 are connected by shoulder pivots generally designated by the numeral 52 to the upper end portions 26 of the vertical members 22 and 24. The entire shoulder member 42 is releasably connected to the shoulder pivot 52 by wing nuts 54. The shoulder member 42 having the neck block 44 shown in FIG. 1 can be removed from the torso frame 20 and replaced with an alternate shoulder member, as for example, the member 56 shown in FIG. 5.

The shoulder member 56 has a configuration substantially conforming to the configuration of the shoulder member 42 shown in FIG. 1 with the exception of the neck block 44. Preferably, the shoulder member 56 is adaptable for more casual and contemporary display of upper garments, such as a shirt open at the neck; whereas the shoulder member 42 having the neck block 44, preferably fabricated of wood, is more desirable in the traditional display of upper garments, such as the combination of a shirt, tie, and jacket. The shoulder member 56 shown in FIG. 5 includes a pair of holes 58 which are adaptable for connection to the shoulder pivots 52 by the wing nuts 54. The shoulder member 42 is also provided with identical holes.

The shoulder pivots 52 permit the shoulder member 42 to be pivoted forwardly and backwardly in a direction indicated by the arrows 60 on the torso frame 20. Positioned below the shoulder member 42 on the frame 20 are a pair of arm members generally designated by the numerals 62 and 64. Each of the arm members 62 and 64 includes an upper portion 66 and a lower portion 68. As illustrated in FIGS. 1 and 2, the arm member portions 66 and 68 have an I-beam like configuration so as to provide a plurality of planar surfaces 70, 72, 74, and 76 of a preselected length and width to simulate the structure of the human arm. The supporting surfaces 70, 72, 74 and 76 provide full form display of the garment in a plurality of positions and, thereby, avoid the undesirable characteristic of many forms of loose draping of a garment, particularly, the sleeves. FIG. 10 illustrates the full form display of the shirt 12 on the display rack 10.

An upper pivot carrying link, generally designated by the numeral 78, connects the upper end portions 66 of the arm members 62 and 64 to the torso frame upper end portions 26 for pivotal movement of the arm member portions 66 in more than one direction relative to the torso members 22 and 24 respectively. In a similar arrangement, a lower pivot carrying link generally designated by the numeral 80 connects the adjacent ends of the arm members upper and lower portions 66 and 68 for pivotal movement of the lower portions 68 relative to the upper portions 66. With this arrangement, the upper and lower pivot carrying links 78 and 80 are independently operable together with the shoulder pivots 52 to permit selective angular positioning of the shoulder member 42 and the arm members 62 and 64 relative to the upper torso frame 20.

The shoulder pivots 52 and the upper and lower pivot carrying links 78 and 80 include identical pivot connections generally designated by the numeral 82. A representative one of the pivot connections 82 is illustrated in detail in FIG. 4.

Each of the shoulder pivots 52 includes an angle brace or link 84 that is connected at one end by the wing nut 54 to the shoulder member 56 and at the opposite end by the pivot connection 82 to the respective vertical member upper end portion 26. With this arrangement, the shoulder member 56 is connected to the angle braces 84, and the angle braces 84 are pivotal relative to torso frame 20 in the direction of arrow 60, as shown in FIG. 1.

Figure 4:
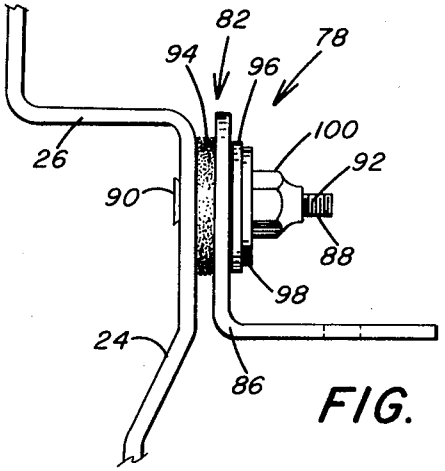
FIG. 4 is a schematic view of the hinge for pivotally connecting an arm member to the torso frame.

In a similar arrangement, the upper pivot carrying link 78 for each arm member 62 and 64 includes an angle brace or link 86 connected at one end by a pivot connection 82 to the torso frame member upper end portion 26, and at an opposite end, by another pivot connection 82 to the respective arm member upper end portion 66. Referring to FIG. 4, there is illustrated the upper pivot carrying link 78 in which the pivot connection 82 for the arm member upper end portion 66 has been omitted for clarity of illustration of the pivot connection 82 to the torso frame upper end portion 26. Each of the pivot connections 82 above discussed is representative of the pivot connection 82 illustrated in FIG. 4.

The pivot connection 82 includes a bolt or fastener 88 having an enlarged head 90 and a threaded shank 92. The fastener 88 extends through a bore in the frame member upper end portion 26 and through a friction disc 94 fabricated of a preselected material, such as asbestos. The disc 94 is positioned securely between the vertical member upper end portion 26 and the angle brace 86. An anti-friction washer 96, preferably fabricated of TEFLON, is positioned on the opposite side of the brace 86 on the fastener 88. Also positioned on the fastener 88 abutting the anti-friction washer 96 is a metal washer 98. In the alternative, a nylon washer (not shown) may be positioned between the washer 96 and washer 98 to increase the coefficient of friction therebetween. Threadedly advanced on the shank portion 92 is a lock nut 100. The lock nut 100 is advanced on the shank portion 92 and tightened to a preset torque to place the disc 94, brace 86, anti-friction washer 96, and washer 98 in frictional engagement while permitting rotational movement of the angle brace 86 about the axis of the fastener 88 to a preselected pivoted position. A further embodiment of the pivot connection 82 includes a Belleville washer (not shown) positioned between the metal washer 98 and the lock nut 100.

The brace 86 together with the respective arm member 62, 64 is pivotal forwardly and backwardly relative to the torso frame 20 through substantially an arc of 360° from a point abutting the rear edge of the shoulder member 42 to a point abutting the front edge of the shoulder member 42. Then, as illustrated in FIG. 1, the entire arm member 62, 64 is pivotal about the second pivot connection 82 on the brace 86 in a direction indicated by the arrow 101. This pivot axis of the arm member 62, 64 is displaced 90° from the pivot axis of the brace 86 on the vertical member upper end portion 26. Throughout this entire range of pivotal movement of the respective arm 62, 64, the arm is operable to remain fixed in a selected pivoted position without any adjustments required to the pivot connection 82. Accordingly, the arm 62, 64 can be easily adjusted to any desired pivoted position. Once the brace 86 has been moved to a selected pivoted position, it is not necessary to make any further adjustments, such as by tightening the lock nut 100 on the fastener 88 to maintain the selected pivoted position. The arm member 62, 64 can be pivoted laterally upwardly and downwardly relative to the brace 86 in the direction of arrow 101. This arrangement is applicable for all the pivot connections 82 of the display rack 10.

As illustrated in FIGS. 1 and 2, the angle brace 86 carries a second pivot connection 82 so that the respective arm member 62, 64 is pivotal relative to the angle brace 86. The pivotal connection of the angle brace 86 to the arm member upper end portion 66 is positioned 90° from the pivotal connection of the angle brace 86 to the torso frame 20. This combination of pivot connections for each arm 62 and 64 permits a first degree of movement of the arms 62 and 64 forwardly and backwardly relative to the torso frame 20, as well as laterally upwardly and downwardly relative to the torso frame 20. Also, it should be noted, as illustrated in FIG. 2, that the arm member upper end portion 66 is positioned in underlying relation with the lower ends of the shoulder member 42 so as to provide a uniform transition from the shoulder member 42 to the arm members upper end portions 66. This is particularly desirable to provide an attractive draping of a garment on the torso form 20.

The lower pivot carrying links 80 are substantially similar to the upper pivot carrying links 78. Each of the lower pivot carrying links 80 includes a link 102 connected by a pivot connection 82 at one end to an angle brace 104 of each arm upper portion 66 and at the opposite end by a pivot connection 82 to an angle brace 106 of the arm member lower portion 68. With this arrangement, the link 102 connects the upper arm portion 66 to the lower arm portion 68.

The link 102, together with the arm member lower portion 68, is 360° rotationally movable relative to the arm member upper portion 66 in the direction indicated by the arrow 108. The arm member lower portion 68 is, in turn, pivotally movable relative to the link 102, as well as to the arm member upper portion 66 in an upward and downward direction as indicated by the arrow 110. Thus with this arrangement, the arm member portions 66 and 68 are pivotally movable relative to one another in more than one direction by the provision of the multiple pivot connections on the lower pivot carrying link 80. Thus the user of the present invention has virtually unlimited possibilities in the arrangement of the angular positions of the arm members 62 and 64, as well as the shoulder member 42 on the torso 20 and the individual arm portions 66 and 68 relative to each other.

The upper garment display rack 10, by the provision of the waist well 30, is self-supporting on a surface, such as a floor or display counter. As illustrated in FIG. 1, the display rack 10 also may be supported on the base 14. The base 14 includes a circular stand 112 of a preselected dimension having a pedestal portion 114. Extending upwardly from the pedestal portion 114 is a bar 116 that is releasably received at one end within a socket of the pedestal portion 114 and at an upper end to a support block 118. The block 118 is a multi-faced structure having a plurality of sockets or recesses in each of the faces. The faces are positioned at an angle relative to each other thereby permitting various angles at which a support rod 120 for the display rack 10 can be positioned. The features of the multi-faced block 118 are described in greater detail in U.S. Pat. No. 4,366,907.

To support the torso frame 20 on the support rod 120 extending upwardly from the pedestal portion 114, the torso frame 20 is provided with a V-shaped brace member 122. Secured to the brace member 122 is a socket housing 124 adapted to receive the upper end portion of the support rod 120. The socket housing 124 is suitably connected as by rivets to the lower end portion of the brace member 122. The socket housing 124 includes a pair of vertically spaced sockets 126 and 128 adapted to receive and frictionally engage the upper end portions of the support rod 120. With this arrangement the support rod 120 is rigidly connected to the torso frame 20, and by adjusting the angular position of the rod 120 relative to the block 118, the angular position of the torso frame 20 can be adjusted relative to the base 14 through 360°, as well as at an angle extending from the horizontal to the vertical.

Now referring to FIGS. 6–9, there is illustrated, in accordance with the method of the present invention, the manner of securing an upper garment such as the shirt 12 to the display rack 10 so as to attractively display the garment on the rack 10 whereby the garment is tightly drawn on the display rack 10 to present a neat display of the shirt 12 as illustrated in FIG. 10. To accommodate securement of an upper garment to the display rack 10, there is provided a plurality of resilient devices generally designated by the numerals 130, 132, 134, 136, 138, 140, 142, and 144. The resilient devices 130–144 are tensionable clips and each includes an elastic strap 146 connected by suitable means at one end portion to a rod 148 that extends through the brace member 122 and is connected by fasteners 150 to the vertical members 22 and 24 above the waist well 30. A jaw-like clip 152 is connected to the opposite end of each of the elastic straps 146. The jaws of the clips 152 are normally maintained in a closed position.

Figure 6:
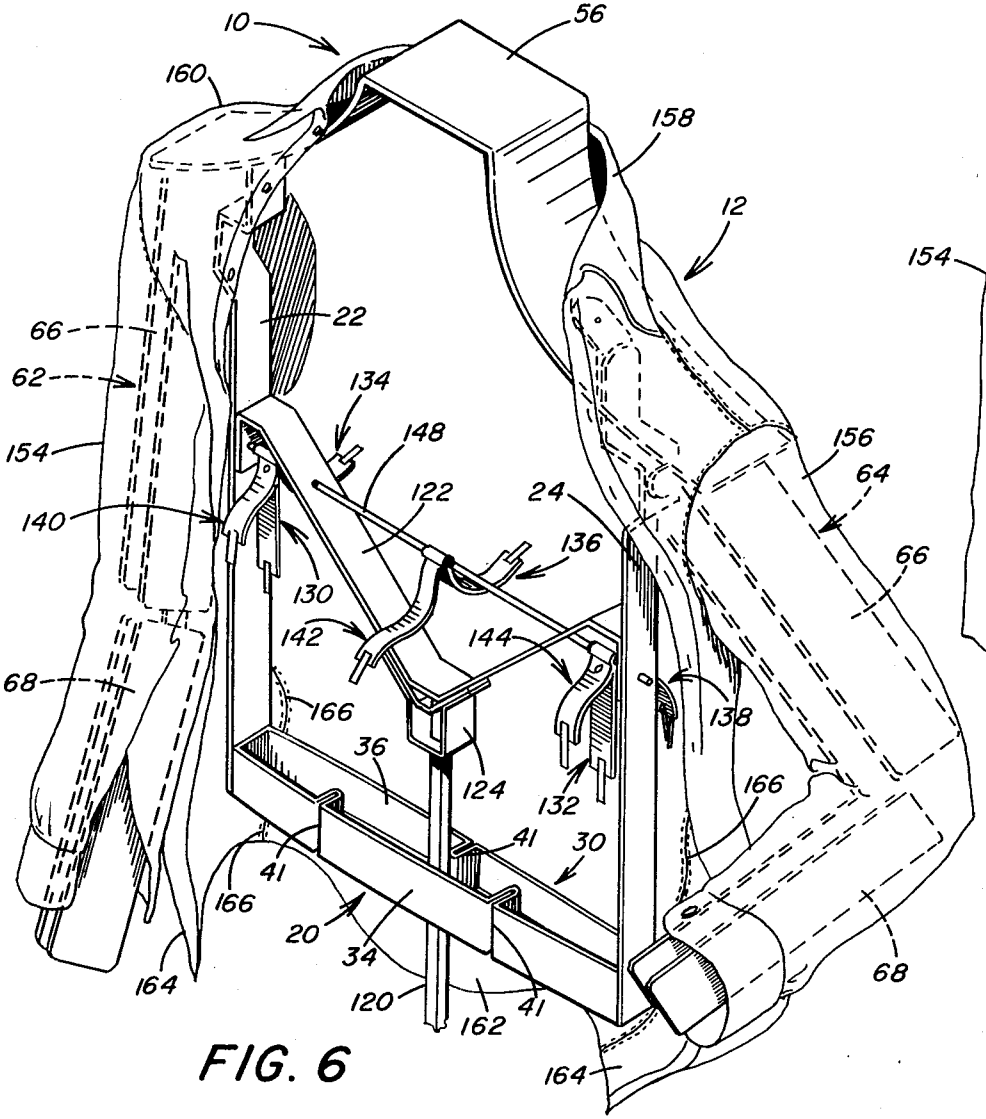
FIG. 6 is a schematic perspective view illustrating the method of positioning an upper garment, such as a shirt, initially on the display rack.

As illustrated in FIG. 6, the shirt is initially positioned on the torso frame 20 so that the sleeve portions 154 and 156 are extended over the respective arm members 62 and 64 with the collar portion 158 and shoulders 160 of the shirt 12 supported by the shoulder member 56. The back of the shirt extends downwardly behind the torso frame 20 with a rear shirt tail 162 extending below the waist well 30. The front of the shirt is brought between the arm members 62, 64 and the vertical members 22, 24 so that the front shirt tails 164 extend forwardly of the waist well 30.

Figure 7:
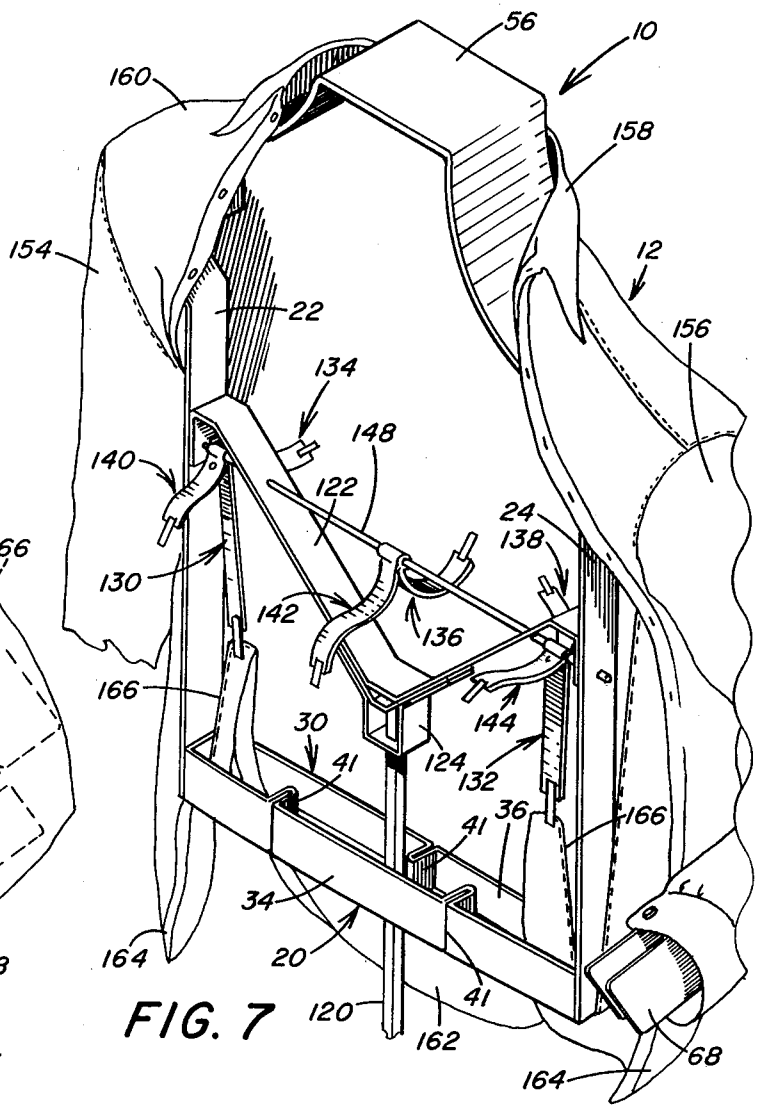
FIG. 7 is a view similar to FIG. 6 illustrating the step of securing the side seams of the garment tightly against the upper torso frame.

With the shirt mounted on the display rack 10, as illustrated in FIG. 6, the side seams 166 of the shirt tails 162 and 164 are brought upwardly through the waist well 30. The tensioned clip device 130 is extended downwardly and by securement with the clip 152 engages the side seam 166 at one side of the shirt. The same procedure is repeated by extending and engaging the tensioned clip device 132 at the opposite side seam 166 as illustrated in FIG. 7.

Figure 8:
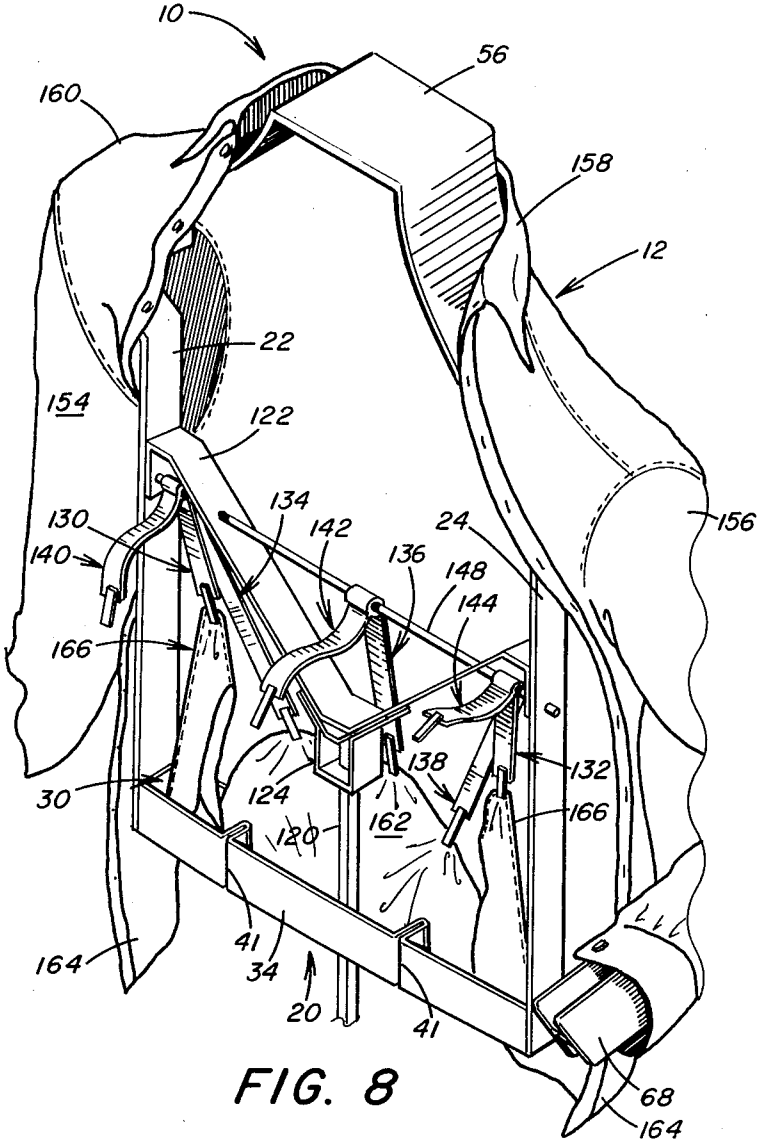
FIG. 8 is a perspective view of a shirt on the display rack, illustrating the step of securing the rear portion of the garment tightly over the upper torso frame.

Once the shirt side seams 166 are extended through the waist well 30 and engaged by the tensioned clip devices 130 and 132, the rear shirt tail 162 is brought up through the waist well 30 as illustrated in FIG. 8. In a similar manner, the rear shirt tail 162 is tightly drawn over the torso frame 20. A portion of the rear shirt tail 162 is creased and guided into the rear notch 41 of the rear waist well bar 36 to form a center pleat or tuck at the back of the shirt 12. Then the rear shirt tail is engaged by the tensioned clip devices 134, 136, and 138.

Figure 9:
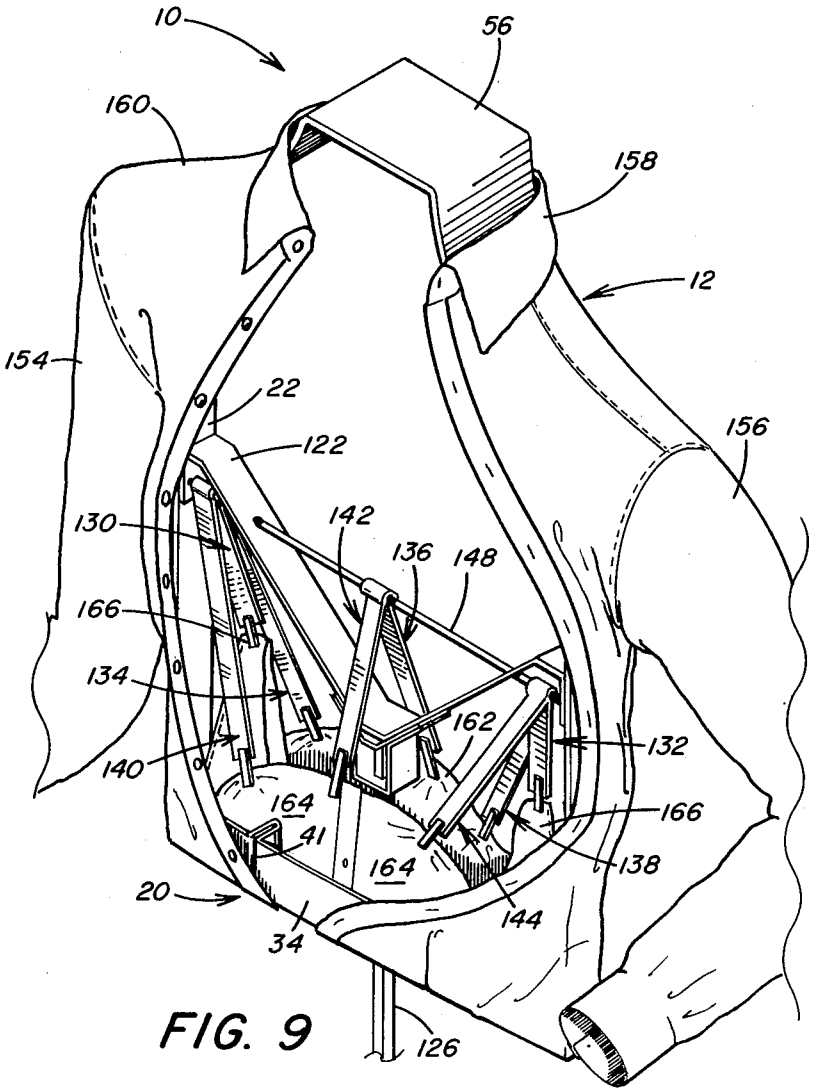
FIG. 9 is a view similar to FIG. 8, illustrating the step of securing the front portion of the garment tightly over the upper torso frame.

Thereafter, as illustrated in FIG. 9, the front shirt tails 164 are brought upwardly around and through the waist well 30 to tightly draw the front of the shirt over the torso frame 20. The front shirt tails 164 are creased and positioned in the notches 41 of the front waist well bar 34 to form the front pleats or tucks of the shirt 12. The front shirt tails 164 are then engaged by the remaining tensioned clip devices 140, 142, and 144 as illustrated in FIG. 9. A preselected degree of tension is placed on each of the elastic straps 146 so that once the respective portions of the shirt are engaged by the clips 142, the shirt is tightly drawn over the torso frame 20 upwardly through the waist well 30. In this manner, the waist well 30 with the opening 40 provides a means for nearly securing the shirt to the rack 10 and forming pleats in the shirt without the need for experienced labor in inserting numerous straight pins to hold the shirt in place on the rack 10.

It should also be understood that prior to securement and display of an upper garment on the rack 10 as above described, a garment, particularly for a shirt, may be buttoned at the top before it is secured by the tensioned clip devices to control the amount of tension placed on the shirt 12. During the securement of the rear shirt tail 162 and the front shirt tails 164, suitable pleats or tucks 168, as illustrated in FIG. 10, are formed and retained on the display rack 10 without the use of straight pins by the provision of the notches 41. The notches 41 in the waist well bars 34 and 36 provide an efficient guide for the location of front and rear pleats, to attractively display a shirt or a blouse on the rack 10. Once the shirt is secured in position by the feature of the tensioned clip devices, the display is completed by buttoning the shirt as illustrated in FIG. 10.

Figure 12:
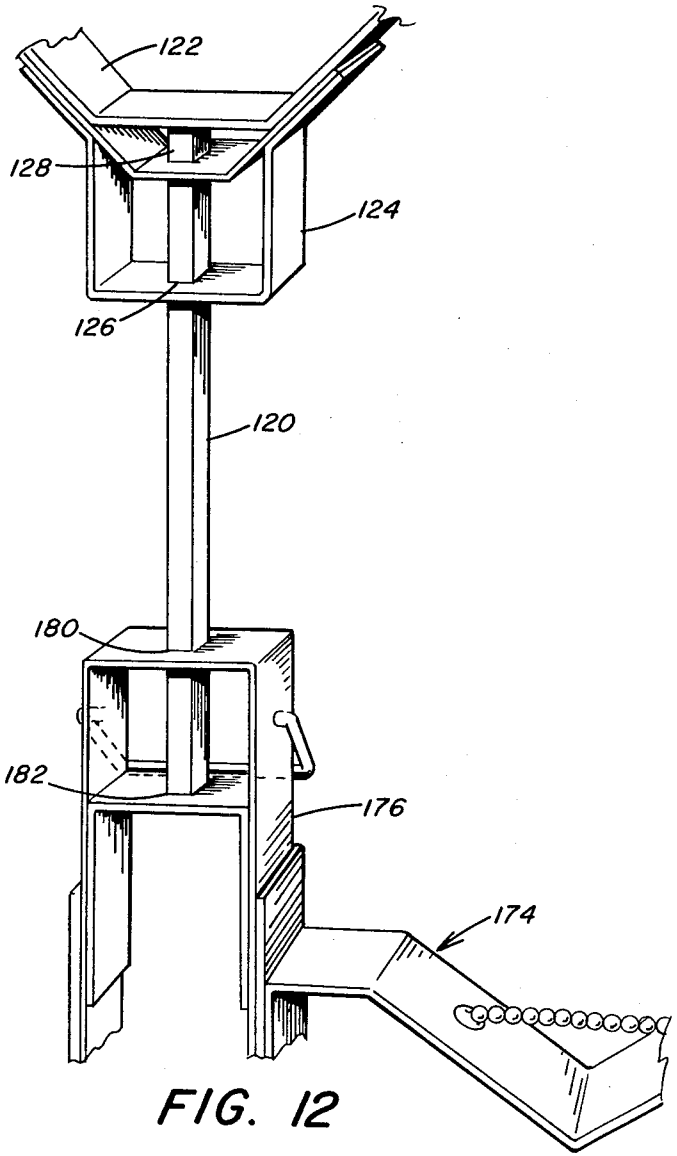
FIG. 12 appearing on the sheet with FIGS. 4 and 5 is an enlarged fragmentary view of the connection of the upper garment display rack to the lower garment display rack for the garment display form shown in FIG. 11.
Figure 11:
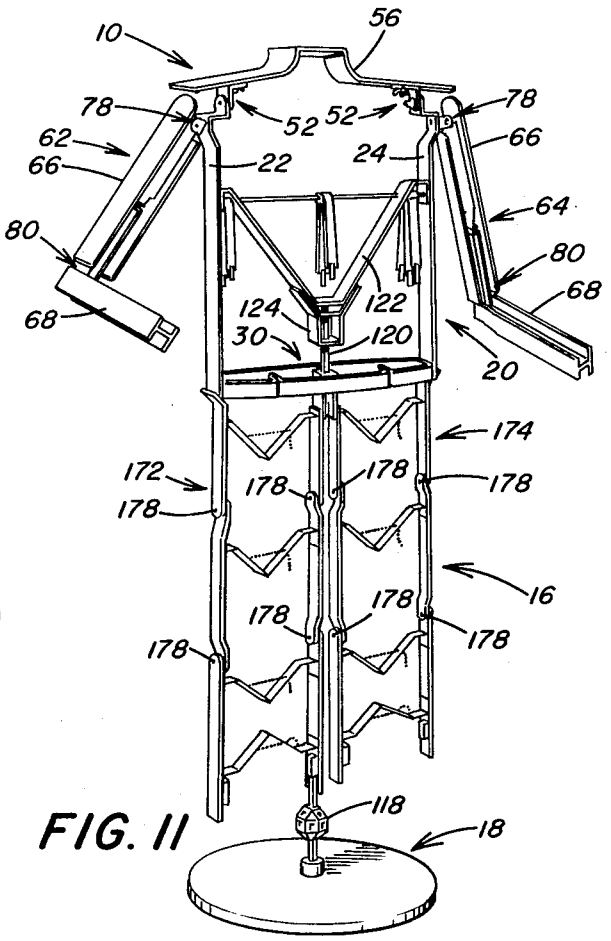
FIG. 11 is a perspective view of a garment display form, illustrating upper and lower garment display racks connected to one another to form a full-figure for the display of garments in accordance with the present invention.

Referring to FIG. 11, there is illustrated the combined structure of the upper garment display rack 10 and the lower garment display rack 16 to provide an integrated full figure display rack generally designated by the numeral 173 for simultaneous display of both upper and lower garments, as illustrated in FIG. 13. The lower garment display rack 16 is described in detail in U.S. Pat. No. 4,311,260, and includes a pair of leg frame members 172 and 174 connected together at their upper end portions by a yoke member 176, illustrated in detail in FIG. 12. The leg frame members 172 and 174 are pivotally connected by a plurality of pivot connections 178 similar to the pivot connections 82 described above. The pivot connections 178 permit the leg frame members 172 and 174 to be independently angularly positioned relative to each other, as illustrated in FIG. 13, to support a pair of trousers in an attractive and imaginative display.

As further explained in U.S. Pat. No. 4,311,260, the leg frame members 172 and 174 are adjustable in width to accommodate the positioning of a pair of trousers on the display rack 16.

To accommodate the connection of the upper garment display rack 10 to the lower garment display rack 16, the leg frame members 172 and 174 at the upper end portions thereof are spring biased and are urged outwardly to receive the waist well 30 therebetween. The upper ends of the leg frame members 172 and 174 are positioned in frictional engagement with the upper torso members 22 and 24 at the waist well 30, as illustrated in FIG. 11. The support rod 120 extending from the socket housing 124 of the upper garment display rack 10 is extended into engagement with the sockets 180 and 182 of the yoke member 176 of the lower garment display rack 16. With this arrangement, the relative spacing between the display racks 10 and 16 is adjustable so as to provide the proper length of the full figure display rack 173 for display of garments as illustrated in FIG. 13.

By connecting the upper ends of the leg frame members 172 and 174 to the waist well 30, the waist well 30 forms the waist of the full figure display rack 173, permitting the trousers supported by the rack 16 to be brought up into engagement with the waist well 30. This forms a natural waistline for the full figured display of garments. Accordingly, the manner of supporting a pair of trousers around the waist well 30 does not interfere with the securement of the shirt 12, as illustrated in FIG. 10, on the upper garment display rack 10. It should also be understood that both the upper and lower garment display racks 10 and 16 can be appropriately dimensioned for both adult and children's garments and the upper rack 10 modified to include bust structure for the display of female garments.

In accordance with the present invention, a plurality of articles of apparel, as illustrated in FIG. 13, can be displayed on the combined racks 10 and 16. Also, as illustrated in FIG. 13, the combined display racks 10 and 16 may be suitably supported on the base 14 using the multi-faced block 118 as above described. Also, in accordance with the present invention, as illustrated in FIG. 13, the upper garment display rack 10 can be so positioned to accommodate the display of various accessories, generally designated by the numeral 184 in FIG. 13. By the provison of the friction-type pivot connections 82, the arm members 62 and 64 can be bent to securely support on the rack 10 various display accessories 184 to enhance the attractiveness of the garments displayed on the rack 10, as well as to permit the display of other items to be merchandised.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. An upper garment display rack comprising, an upper torso frame including a pair of upwardly extending torso members positioned in spaced relation, each of said torso members having an upper end portion and a lower end portion, an open waist well extending transversely between said torso members and connected to said torso members lower end portion, a shoulder member extending transversely above said torso members upper end portions, shoulder pivot means for pivotally connecting said shoulder member to said torso members upper end portions for forward and backward movement of said shoulder member relative to said upper torso frame, a pair of arm members positioned adjacently to said pair of torso members respectively, each of said arm members having an upper portion and a lower portion, said upper and lower portions having adjacently positioned ends, said upper and lower portions having supporting surfaces for receiving a garment to support the garment for display in a plurality of positions, upper pivot carrying link means for connecting said arm members upper portions to said torso members upper portions for pivotal movement of said arm members upper portions in more than one direction relative to said torso members, said arm members being pivotally movable independently of said shoulder member and said shoulder member being movable independently of said arm members such that said shoulder member and said arm members are capable of being positioned in a plurality of positions independently of one another, lower pivot carrying link means for connecting said adjacent ends of said arm members upper and lower portions for pivotal movement of said lower portions in more than one direction relative to said upper portions, and said upper and lower pivot carrying link means being independently operable together with said shoulder pivot means to permit selective angular positioning of said shoulder member and said arm members relative to said upper torso frame.

2. An upper garment display rack as set forth in claim 1 which includes, means for releasably connecting said shoulder member to said shoulder pivot means.

3. An upper garment display rack as set forth in claim 1 which includes, a base for supporting said upper torso frame, a support receiving housing connected to said upper torso frame between said waist well and said shoulder member, and a support member extending from said base and passing through said waist well for connection to said support receiving housing to support said upper torso frame on said base.

4. An upper garment display rack as set forth in claim 1 which includes, pleat forming means on said waist well for receiving portions of the garment displayed on the rack to locate the positioning of pleats and the formation of pleats in the garment positioned on the rack.

5. An upper garment display rack as set forth in claim 4 in which, said pleat forming means includes a plurality of notches carried by said waist well, said notches being selectively positioned for the location of pleats in the garment at a preselected position on the garment.

6. An upper garment display rack as set forth in claim 1 in which, said waist well includes a band-like member extending between said torso members and including a front bar spaced from a rear bar by a pair of side bars, and said front and rear bars being spaced apart to receive parts of the garment between said front and rear bars and permit the garment to be drawn tightly over said upper torso frame.

7. An upper garment display rack as set forth in claim 1 which includes, resilient means supported by said upper torso frame for engaging portions of the garment to exert tension on the garment and tightly draw the garment over said upper torso frame.

8. An upper garment display rack as set forth in claim 7 in which, said resilient means includes an elastic strap secured at one end to said upper torso frame above said waist well, a clip device connected to the other end of said elastic strap, said clip device being releasably engageable with a portion of the garment, said elastic strap being expandable to position said clip device for receiving the garment under tension over said upper torso frame and through said waist well, and said clip device being releasably engageable with a portion of the garment to exert tension on selected portions of the garment to tightly support the garment on said upper torso frame.

9. An upper garment display rack as set forth in claim 1 in which, said upper pivot carrying link means includes a link member having angularly disposed end portions, a first friction hinge pivotally connecting one end portion of said link member to said respective torso member upper end portion for pivotal movement of said link member about a first pivot axis, a second friction hinge pivotally connecting the other end portion of said link member to said respective arm member upper portion for pivotal movement of said arm member upper portion about a second pivot axis, and said first pivot axis being angularly displaced from said second pivot axis to permit angular movement of said respective arm member relative to said upper torso frame about more than one pivot axis.

10. An upper garment display rack as set forth in claim 1 in which, said lower pivot carrying link means includes a link member extending between each of said arm member upper and lower portions, said link member having opposite end portions, a first friction hinge pivotally connecting one end portion of said link member to said arm member upper portion for pivotal movement of said link member about a first pivot axis, a second friction hinge pivotally connecting the other end portion of said link member to said arm member lower portion for pivotal movement of said arm member lower portion about a second pivot axis, and said first pivot axis being angularly displaced from said second pivot axis to permit angular movement of said arm member lower portion relative to said arm member upper portion about more than one pivot axis.

11. An upper garment display rack comprising, a torso frame for receiving and supporting an upper body garment, said torso frame having an upper portion and a lower portion, said torso frame including a pair of upwardly extending torso members positioned in spaced relation, a shoulder member secured to and extending transversely between said torso members at said torso frame upper portion, an open waist well secured to and extending transversely between said torso frame lower portion, resilient means supported by said torso frame above said waist well for engaging portions of a garment brought upwardly through the waist well to draw the garment over the waist well and thereby conceal the waist well, and said resilient means being releasably engageable under tension with selected portions of the garment adjacent said waist well such that when the portions of the garment are engaged the resilient means is placed in tension and is drawn tightly over said torso frame to attractively display the garment on said torso frame.

12. An upper garment display rack as set forth in claim 11 which includes, pleat forming means associated with said waist well for receiving and securing portions of the garment on the waist well to locate the position on the garment for formation of pleats in the garment on said torso frame.

13. An upper garment display rack as set forth in claim 12 in which, said pleat forming means includes a plurality of recesses in said waist well, and said recesses being located in a position to guide the garment in a position on said torso frame for the selective positioning and formation of pleats in the garment being displayed on said torso frame.

14. An upper garment display rack as set forth in claim 1 in which, said waist well includes a band extending around said torso frame lower portion, said band forming an opening for receiving a portion of the garment extending downwardly from said torso frame, around said band, and upwardly through said opening, and said resilient means extended under tension into engagement with the portions of the garment extending through said waist well opening to exert tension on the garment and draw the garment tightly over said torso frame.

15. An upper garment display rack as set forth in claim 14 which includes, pleat forming means selectively positioned on said waist well band for receiving portions of the garment to guide the portions of the garment into a position for forming pleats at selected points on the garment being displayed on said torso frame.

16. An upper garment display rack as set forth in claim 11 in which, said resilient means includes an elastic strap secured at one end to said torso frame above said waist well, a clip device connected to the other end of said elastic strap, said clip device being releasably engageable with a selected portion of the garment, and said elastic strap being expandable to position said clip device for engaging the garment drawn under tension over said torso frame and past said waist well to tightly secure the garment on said torso frame.

17. An upper garment display rack as set forth in claim 16 which includes, guide means positioned on said waist well for folding the garment in selected positions on said torso frame to form folded pleats in the garment being displayed on said torso frame, and said clip device being engageable with a portion of the garment to maintain the garment under tension on said torso frame to retain the folded pleats in the garment on display.

18. A method for displaying an upper garment on a display form comprising the steps of, draping the body of a garment on an upper torso frame, supporting the sleeves of the garment in preselected angular positions relative to the upper torso frame, engaging opposite side seams of the garment by tension means to draw the side seams tightly against the side of the upper torso frame, folding front and back portions of the garment upwardly in surrounding relation with the lower portion of the upper torso frame, and engaging the front and back portions of the garment under tension to tightly draw the front and back portions against the upper torso frame to secure the garment in a preselected position on the upper torso frame.

19. A method for displaying an upper garment on a display form as set forth in claim 18 which includes, folding the front and rear portions of the garment to form folded pleats in selected positions on the garment being displayed on the upper torso frame, and securing the folded pleats under tension to the upper torso frame to retain the pleats in a preselected position.

20. A rack for displaying upper and lower garments comprising, an upper torso frame including a pair of upwardly extending upper torso members positioned in spaced relation, each of said torso members having an upper end portion and a lower end portion, an open waist well extending transversely between said upper torso members and connected to said upper torso members lower end portions, a shoulder member extending transversely above said upper torso members upper end portions, shoulder pivot means for pivotally connecting said shoulder member to said upper torso members upper end portions, a pair of arm members positioned adjacently to said pair of upper torso members respectively, each of said arm members having an upper portion and a lower portion, said upper and lower portions having adjacently positioned ends, upper pivot means for connecting said arm members upper portions for pivotal movement in more than one direction relative to said upper torso members, lower pivot means for connecting said adjacent ends of said arm members upper and lower portions for pivotal movement of said lower portions in more than one direction relative to said upper portions, a lower torso frame including a pair of leg frames positioned in side by side relationship, connecting means for connecting said pair of frame members in side by side relationship, each of said leg frames including a plurality of elongated elements positioned in end to end relationship, means for pivotally connecting said elongated elements in end to end relationship so that each of said leg frames is pivotal at a plurality of pivot points along the length thereof, each of said leg frames including an upper end, and means for detachably connecting said upper ends of said leg frames to said open waist well to connect said lower torso frame to said upper torso frame to form a full figure garment display rack.

* * * * *